United States Patent [19]

Lemire

[11] Patent Number: 5,007,633

[45] Date of Patent: Apr. 16, 1991

[54] SPINAL COLUMN SUPPORT ATTACHMENTS FOR A WEIGHT LIFTER'S BENCH

[76] Inventor: Brett J. Lemire, 5606 Laguna Oaks Dr., Elk Grove, Calif. 95758

[21] Appl. No.: 512,134

[22] Filed: Apr. 20, 1990

Related U.S. Application Data

[62] Division of Ser. No. 385,380, Jul. 27, 1989, Pat. No. 4,953,857.

[51] Int. Cl.[5] ..... A63B 21/078

[52] U.S. Cl. ..... 272/123; 272/144; 128/78

[58] Field of Search ..... 272/123, 119, 143, 144, 272/900, 117; 128/68, 69, 78, 87 R, 87 B; 2/321, 322, 336, 338

[56] References Cited

U.S. PATENT DOCUMENTS

| | | | |
|---|---|---|---|
| 1,904,039 | 4/1933 | Bruder | 272/144 |
| 2,461,682 | 2/1949 | DeFerrari | 272/900 X |
| 2,843,858 | 7/1958 | Bjorklund | 272/900 X |
| 3,524,643 | 8/1970 | Hazelitt, Sr. | 272/900 X |
| 4,157,088 | 6/1979 | Gracey | 128/70 X |
| 4,159,020 | 6/1979 | von Soiron et al. | 128/78 X |
| 4,230,099 | 10/1980 | Richardson | 128/69 |
| 4,474,370 | 10/1984 | Oman | 272/144 |
| 4,492,375 | 1/1985 | Connelly | 272/144 X |
| 4,621,809 | 11/1986 | Pearl | 272/123 |
| 4,710,991 | 12/1987 | Wilmore et al. | 272/144 X |
| 4,756,090 | 7/1988 | Pedrou | 128/78 X |
| 4,768,499 | 9/1988 | Kemp | 128/78 |
| 4,794,916 | 1/1989 | porterfield et al. | 128/78 |
| 4,796,315 | 1/1989 | Crew | 128/78 X |
| 4,905,993 | 3/1990 | Barone | 272/123 |
| 4,927,139 | 5/1990 | Taltre | 272/144 |

*Primary Examiner*—Robert Bahr

[57] ABSTRACT

Accessory spinal support pads for reclined or slightly inclined weight lifting on weight lifting benches are provided in a cervical support pad and a lumbar support pad, with each pad having a central spinal protecting and stabilizing groove. The two support pads are removably attachable to a weight bench in combination or as single units. The cervical support pad has crescent shaped edges adjacent the lifter's shoulders and arms. The crescent shaped edges provide clearance for the user's shoulders and arms to allow movement by the weight lifter's arms without interference from the support pad while the remainder of the pad fully supports and stabilizes the spine in the neck area. Both support pads are affixed with belting to allow stationary yet adjustable attachment of the pads to virtually any weight bench.

2 Claims, 7 Drawing Sheets

SPINAL COLUMN SUPPORT ATTACHMENTS FOR A WEIGHT LIFTER'S BENCH

This is a division of Ser. No. 07/385,380, filed July 27, 1989, now U.S. Pat. No. 4,953,857.

BACKGROUND OF THE INVENTION

1. Field of the Invention

This invention relates to support pads useful on weight lifter's benches to prevent compression and abnormal curvature of the spine during weight lifting. The present invention is particularly directed towards attachable padding shaped to provide support for the cervical and lumbar spinal areas of the weight lifter during weight lifting exercise.

2. Description of the Prior Art

In the course of lifting weights from a reclining position, the lifter tends to straighten his or her neck and lumbar area of the spine due to the force of the weights. The normal human spinal column is maintained roughly in a double S-curve which functions like a coil or spring to decrease and distribute forces through the spine. Long term weight lifting can alter the normal curvature of the spine and can create undue stress on supporting spinal musculature. Unequal stress of the muscles supporting the spine, as well as direct pressure applied to individual vertebrae, can create misalignment of one or more of vertebrae. There are twenty-four individual vertebrae, together with two other fused structures, which comprise the human spinal column. All of these vertebrae have bony prominences, known as spinous processes, projecting outward from the back which can be felt, and often seen, as hard knobs along the exterior of the spine. These individual vertebrae are connected and supported by various cartilages, muscles and ligaments which allow flexibility for bending and twisting of the torso. Each individual vertebra is separated by an intervertebral disc which functions as a cushion and a spacer, helping to prevent compression of the peripheral spinal nerves branching off from the spinal cord housed within the spinal column. Displacement of one or more of the individual vertebrae from its normal position, or altering the curvature of an area of the spine, can create pressure against associated spinal nerves, most often resulting in pain. Since the spinous processes of many vertebrae project prominently from the human back during various stages of weight lifting, the soft tissue covering the back over the spinous processes can easily become irritated from direct pressure exerted from the bench or pad. When too much pressure is exerted against the spinous processes the involved vertebrae can also become misaligned. Therefore, direct pressure applied against the spine and deviation from the normal spinal curvature is to be avoided during weight lifting to prevent pain and possibly injury.

Modifications have therefore been made in the past to provide weight lifting benches which include lumbar and cervical supports. The majority of these supports however, are incorporated as integral units of a specialized bench and cannot be removed or adjusted. Many of these modified benches and pads are not structured to alleviate pressure applied directly onto the spine.

Early recognition of the need to prevent a reduction of spinal curvature loss when the human body is reclined and under physical stress is seen in U.S. Pat. No. 1,904,039, dated Apr. 18, 1933, issued to E. A. Bruder.

Bruder's invention is not directed towards weight lifting but concerns the prevention of unnecessary strain upon normal spinal curvature during regular, reclined exercising, such as sit-ups or leg lifts. Bruder's device does not contain structuring for preventing direct pressure on the spinous processes of the back bone, nor is it adapted for secure attachment to a stationary surface, such as a bench, to avoid displacement during exercise.

The patent issued to W. A. Pearl, U.S. Pat. No. 4,621,809, dated Nov. 11, 1986, teaches a weight lifting bench having an upper surface configured with portions anatomically contoured for supporting and restraining the reclined lifter from lateral and longitudinal shifting. The integral contoured portions of Pearl's bench are not adapted for use as releasable attachment onto a conventional weight lifting bench, nor does he attempt to protect the spinous processes of the vertebrae from direct pressure.

K. W. Oman was granted a U.S. Pat. No. 4,474,370, dated Oct. 2, 1984, for a similar device of a therapeutic weight lifter's bench having cervical and lumbar support cushions. Although the lumbar support cushion is adjustable, neither the cervical or lumbar cushions are adapted for use on other weight lifting benches. The Oman device also fails to provide structuring for preventing pressure directly on the spinous processes.

A U.S. patent was granted on a modified headrest pillow to Wilmore et al, patent number 4,710,991, dated Dec. 8, 1987. Although Wilmore's preferred embodiment teaches a headrest which is primarily designed for supporting of the head of a patient when in a prone position for receiving medical treatment of some sort, an accessory cervical pillow is also taught for supporting the neck area when the patient is in a supine position, such as when sitting in a dentist's chair. The cervical pillow however, is filled with a gelatinous substance which allows the surface of the pillow to be molded into conforming to the shape of the user's neck. Although Wilmore's pillow may provide comfortable support, it is not structured to maintain the cervical vertebrae within a given curvature when under moderate or high compression. Wilmore's pillow therefore appears to be too easily deformed and therefore incapable of providing sufficient structural support in such circumstances as weight lifting. The pillow, although removably affixed, is not adapted for use with existing weight lifting benches without modification of the bench itself, specifically adhesion of a mating hook and loop fastener. If it were concluded Wilmore's pillow were rigid enough to provide sufficient curvature support for the cervical vertebrae, then excess pressure would then be exerted on the spinous processes of the vertebrae, since there are no structures, other than the current high deformity of the pillow itself, for protecting the spinous processes from excess pressure.

B. H. Richardson was granted U.S. Pat. No. 4,230,099, dated Oct. 28, 1980, for a device for aligning the spine. Richardson teaches a pad which is positioned under the back of the reclining user for as a medical application or treatment. The pad contains two parallel ridges which are positioned on either side of the spine in use. This device is designed to realign misaligned vertebra and is not structured for use during exercise or weight lifting. It appears the Richardson device would be too rigid for comfortable use during weight lifting. He also has not provided structuring to allow secure attachment to a weight lifting bench.

The spinal supports shown in the foregoing devices show recognition of the need for a practical padding to protect the human back during weight lifting. However, none of the past art devices make provisions to eliminate pressure exerted directly on the spine during various sequences of weight lifting procedures. None have removable lumbar and cervical support pads adapted for removable attachment to existing conventional weight lifting benches without prior modification of their pad or the bench. The vast majority of conventional weight lifting benches currently in use today are narrow padded benches which are not structured for secure attachment of accessory articles such as padding. Since there are already many thousands of these conventional weight lifting benches now in use in private clubs and homes, it would be less costly to provide support pads which are readily releasably attachable to these existing benches. Modifications of the bench and or pad would therefore be eliminated with removable accessory padding, and the cost would be greatly reduced in purchasing the pads alone, compared to the purchase of a modified bench with integral support pads.

SUMMARY OF THE INVENTION

In practicing my invention, I provide padded supports which reduce the danger of the individual weight lifter losing back curvature during weight lifting from a reclined position, and also, I provide structuring to relieve the pressure exerted directly on the spinous processes in the lumbar and cervical region of the spine.

To accomplish back curvature protection and insure comfortable back and neck support for the individual lifting weights from a reclined or slightly inclined position, the immediate invention provides two support pads attachable to a conventional weight lifter's bench. In structuring the pads, consideration has been taken into account for providing each pad with contouring compatible with the shape of the area of the human anatomy to be supported, specifically the cervical and lumbar area of the spine. The cervical support pad is roughly triangular in shape having a flat bottom surface and a rounded top surface containing a transverse central recess or groove which divides the top surface into two domed-shaped pad surfaces. One edge of this cervical support pad, on both sides of the recess or groove is a crescent shaped curve which is positioned adjacent the person's shoulders in use, with the transverse recess aligned parallel with the spine. The thickest portion of the cervical support pad is positioned directly under the neck of the user, with crescent shaped edges positioned under the shoulders, gradually converging to a rounded point at one end of the transverse recess. This provides support for the cervical vertebrae as well as a portion of the upper thoracic vertebrae as well. The double crescent shaped edge of the pad allow the person exercising with weights to move his arms freely without the edges of the cervical support pad rubbing on his shoulders or restricting upward movement of his or her arms. The ends of the cervical support narrow into elongated straps for attachment to the weight bench.

The lumbar support pad is primarily rectangular in shape but is structured similar to the cervical support pad with a double domed shaped top surface separated by a transverse recess. The lumbar support pad is slightly thicker and wider than the cervical pad with the transverse recess being more pronounced. The ends of lumbar support pad also narrow into attachment straps. The lumbar support pad is positioned under the lower back or lumbar spinal area of the user in use with the transverse recess aligned parallel with the spine.

The contour of the surface of both pads is structured to conform to the normal curvature of the respective spinal areas of an adult human when the user is reclining, and although both support pads are sufficiently resilient for comfort, they are primarily structured to be semi-rigid to maintain a specific degree of curvature when compressed. The transverse central recesses of both pads are adapted to relieve the pressure normally placed on the spinous processes of the vertebrae when the human body is reclined supine. The central recess becomes especially useful as the spine is compressed against the pad, where a protective hollow is formed for the spine by the recess, thus eliminating direct pressure. The central recess also serves to prevent lateral displacement of the spine during exercise. The ends of the attachment straps of both support pads are affixed with some form of coupling means, such as hook and loop fasteners or buckle-type connectors, for attachment of the straps under the weight lifting bench. By providing releasable attachment means the pads can be individually adjusted for the height of each user. The securement of the support pads also provides the user with a measure of stability on the bench, reducing lateral and longitudinal sliding. The gradual sloping sides of the transverse recess tends to create a cradle-like effect which also helps to prevent lateral shifting of the weight lifter.

Each pad is structured with an outer covering of moisture impervious material which prevents absorption of perspiration into the pad. The covering houses an internal layer of semi-rigid padding which is minimally compressible to maintain sufficient spinal curvature support, yet still resilient enough for comfort.

Therefore, it is a primary object of the invention to provide support padding for use on a weight lifter's bench, which maintains and stabilizes correct spinal curvature and protects against spinal compression.

Another object of my invention is to provide the above in a cervical spine support pad and a separate lumbar spine support pad with both pads structured to relieve direct pressure against the spine of a human lifting weights.

Another object of my invention is to provide the above in a cervical spine support pad and a lumbar spine support pad with both pads being adjustably and removably attachable to a weight lifter's bench.

A further object of my invention is to provide the above in a cervical support pad and a lumbar support pad which are attachable to virtually any existing weight lifter's bench without having to make modification or alteration of that bench.

Other objects and the many advantages of this invention will become clear and understood by reading descriptions of the numbered parts in the remaining specifications and comparing them with like numbered parts illustrated in the accompanying drawings.

DESCRIPTION OF THE PREFERRED EMBODIMENTS

Figure 1:
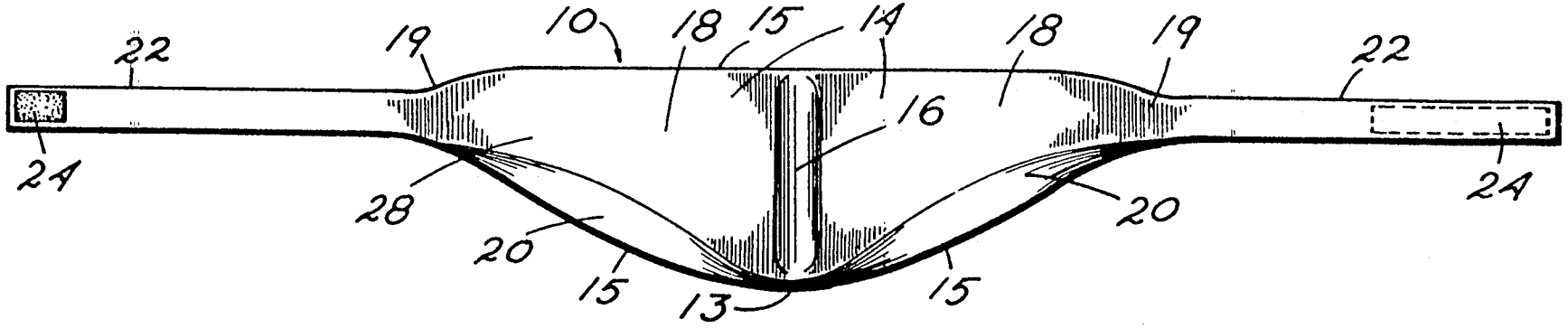
FIG. 1 is a top plan view of the cervical support pad, shown affixed with hook and loop type fasteners on the distal ends of the straps.
Figure 2:
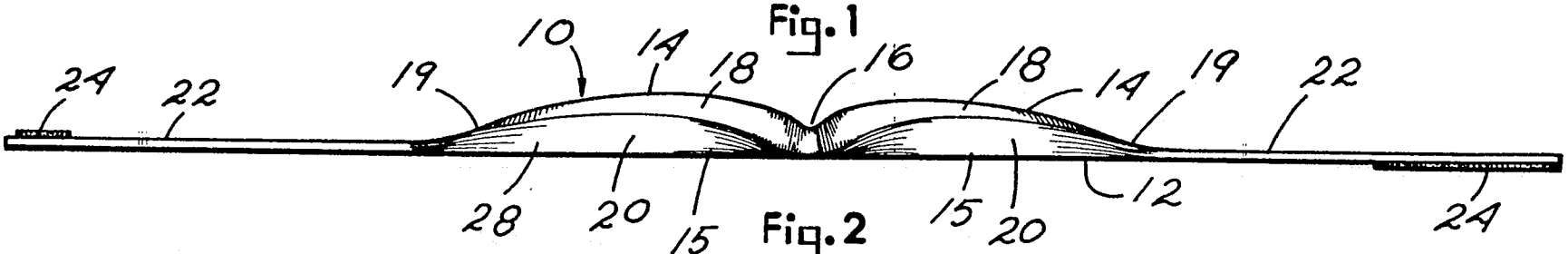
FIG. 2 is a side view thereof.
Figure 3:
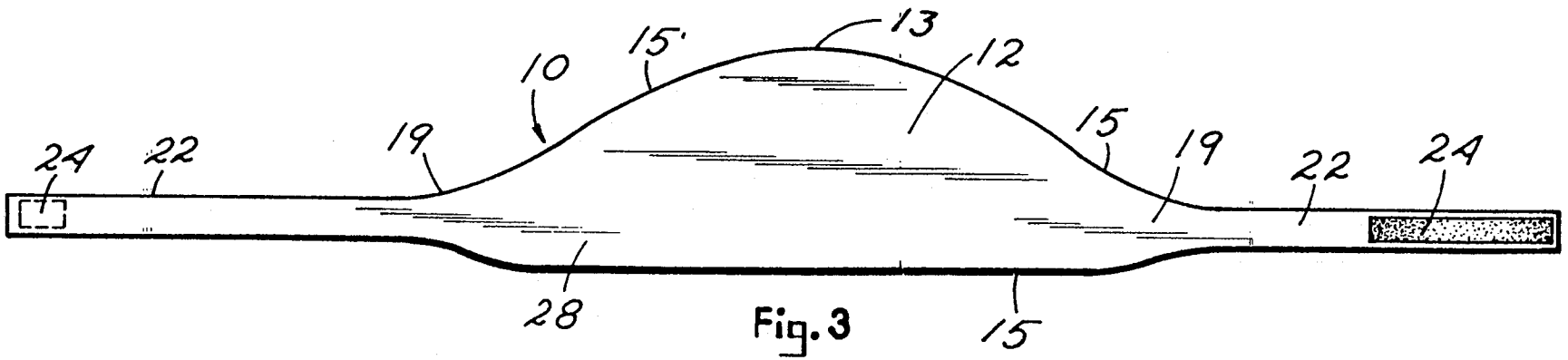
FIG. 3 is a bottom view thereof.

Referring now to the drawings where both embodiments of the invention are illustrated. FIG. 1 shows a top plan view of cervical support pad 10. Cervical support pad 10 is roughly triangular in shape and structured with a flat bottom surface 12, shown in FIG. 3, a oppositely disposed rounded top surface 14, two narrow side edges 15, and two ends 19. One side edge 15 is generally straight with the oppositely disposed edge 15 being angled outward forming a point or apex 13, thereby creating a generally triangular cervical support pad 10. Top surface 14 contains a central groove running from the center of the straight side edge 15 to apex 13 of the opposite angled edge 15. This central groove is referred to as spinal recess 16. Spinal recess 16 divides top surface 14 into two padded rounded domes 18, best shown in FIG. 2. The exterior angled edges 15 adjacent apex 13 are formed with crescent shaped notches known as shoulder recesses 20, best shown in FIG. 1. The particular function of shoulder recesses 20 will be further explained later on in the specification. Both the straight and angled edges 15 of cervical support pad 10 converge towards one another forming narrow ends 19, shown in FIG. 1 and 3. Narrow ends 19 extend outward longitudinally, forming two belts or straps 22 which are positioned perpendicular to spinal recess 16. The distal ends of each strap 22 are affixed with an attachable structure, shown here in FIGS. 1, 2 and 3 as hook and loop fasteners 24.

Figure 4:
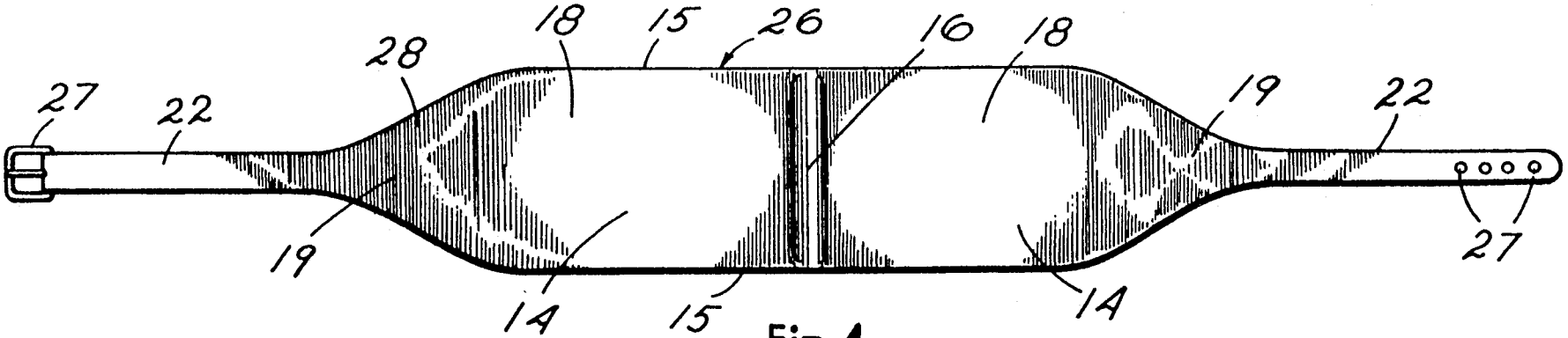
FIG. 4 is a top plan view of the lumbar support pad, shown affixed with buckle-type fasteners.
Figure 5:
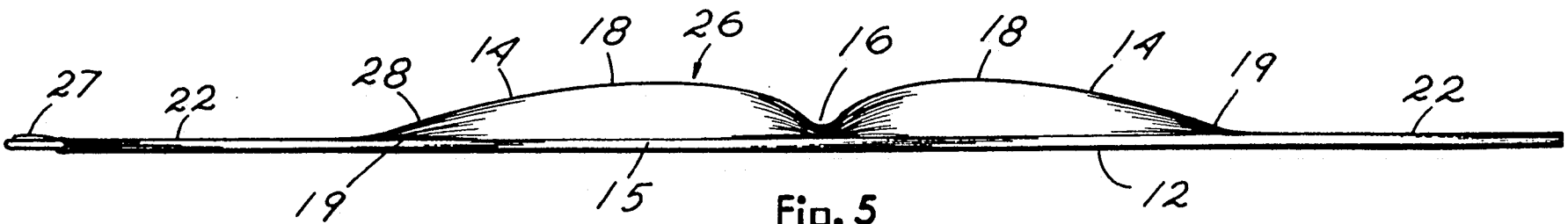
FIG. 5 is a side view thereof.
Figure 6:
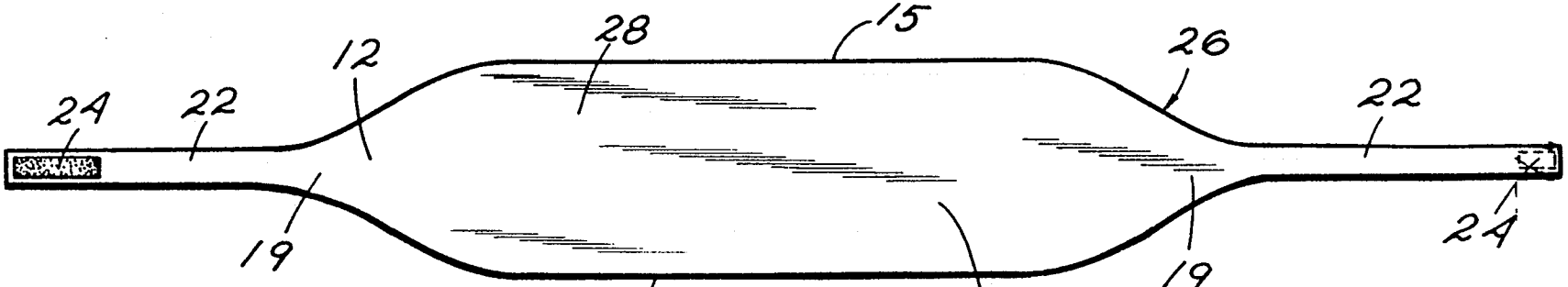
FIG. 6 is a bottom plan view of FIG. 4, with hook and loop fasteners substituted for the attachment buckle-type fasteners.

FIG. 4, 5 and 6 illustrates various views of lumbar support pad 26. Lumbar support pad 26 is substantially rectangular in shape and consists of flat a bottom surface 12, an oppositely disposed rounded top surface 14 similar to that of cervical support pad 10, two narrow parallel side edges 15, and two oppositely disposed ends 19. The top surface 14 of lumbar support pad 26 also contains a central transverse groove, spinal recess 16, which divides top surface 14 into two generally rounded domes 18. Spinal recess 16 of lumbar support pad 26 runs from one side edge 15 to the opposite side edge 15. The outer ends 19 of lumbar support pad 26 narrow into elongated belts or straps 22. FIG. 4 and 5 illustrate lumbar support pad 26 affixed with buckle type fasteners 27 to merely illustrate an alternative attachment structure other than hook and loop fasteners 24, which are shown affixed to lumbar support pad 26 in FIG. 6.

Figure 7:
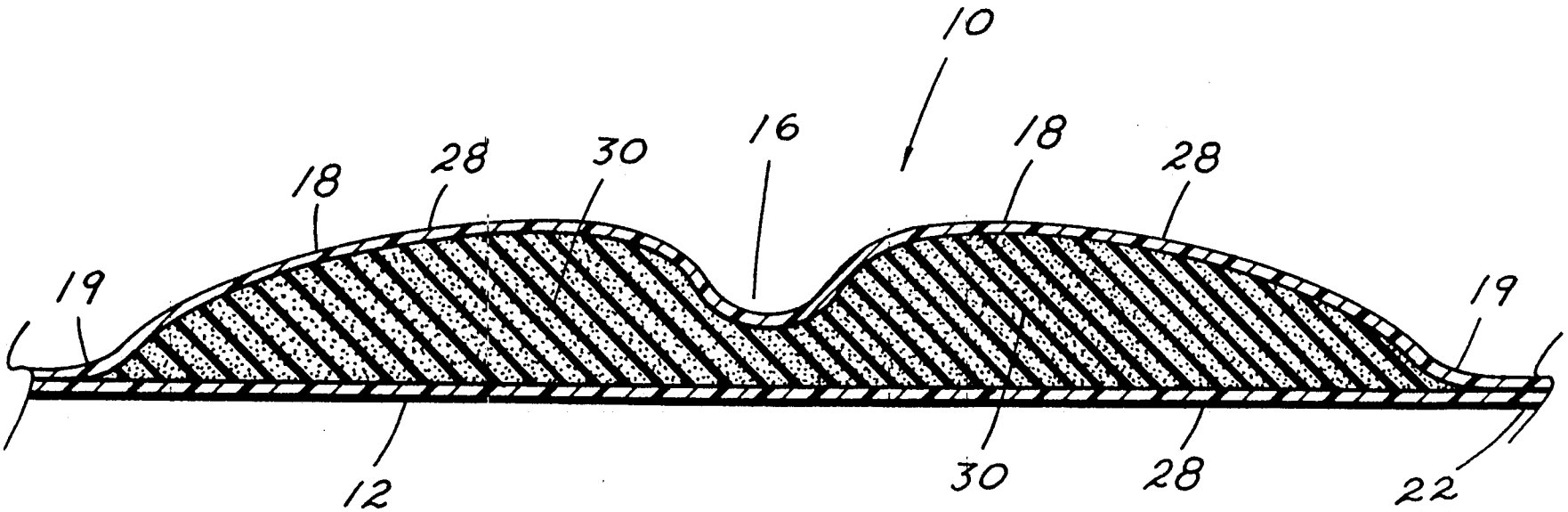
FIG. 7 is a longitudinal cross-sectional view of the cervical support pad as shown in FIG. 2.

As material choices are not critical to operational factors, the materials of manufacture of both pads 10 and 26 are given merely as suggestions. Both pads 10 and 26 are structured of an outer covering 28 consisting of flat bottom surface 12 affixed on the peripheral edges 15 to top surface 14. Straps 22 also consist of outer covering 28. Outer covering 28 is comprised of a moisture impervious, resilient, durable material, such as plastic or leather. Outer covering 28 creates an interior housing for at least one layer of semi-rigid padding 30, shown in FIG. 7, preferably a moderate to high density closed celled foam plastic. Although the resilient yet semi-rigid padding 30 is slightly compressible for comfort, it is structured to be fairly rigid to maintain proper spinal support. Other materials may be used in the manufacture of pads 10 and 26, including a canvas covering with cotton padding.

Figure 8:
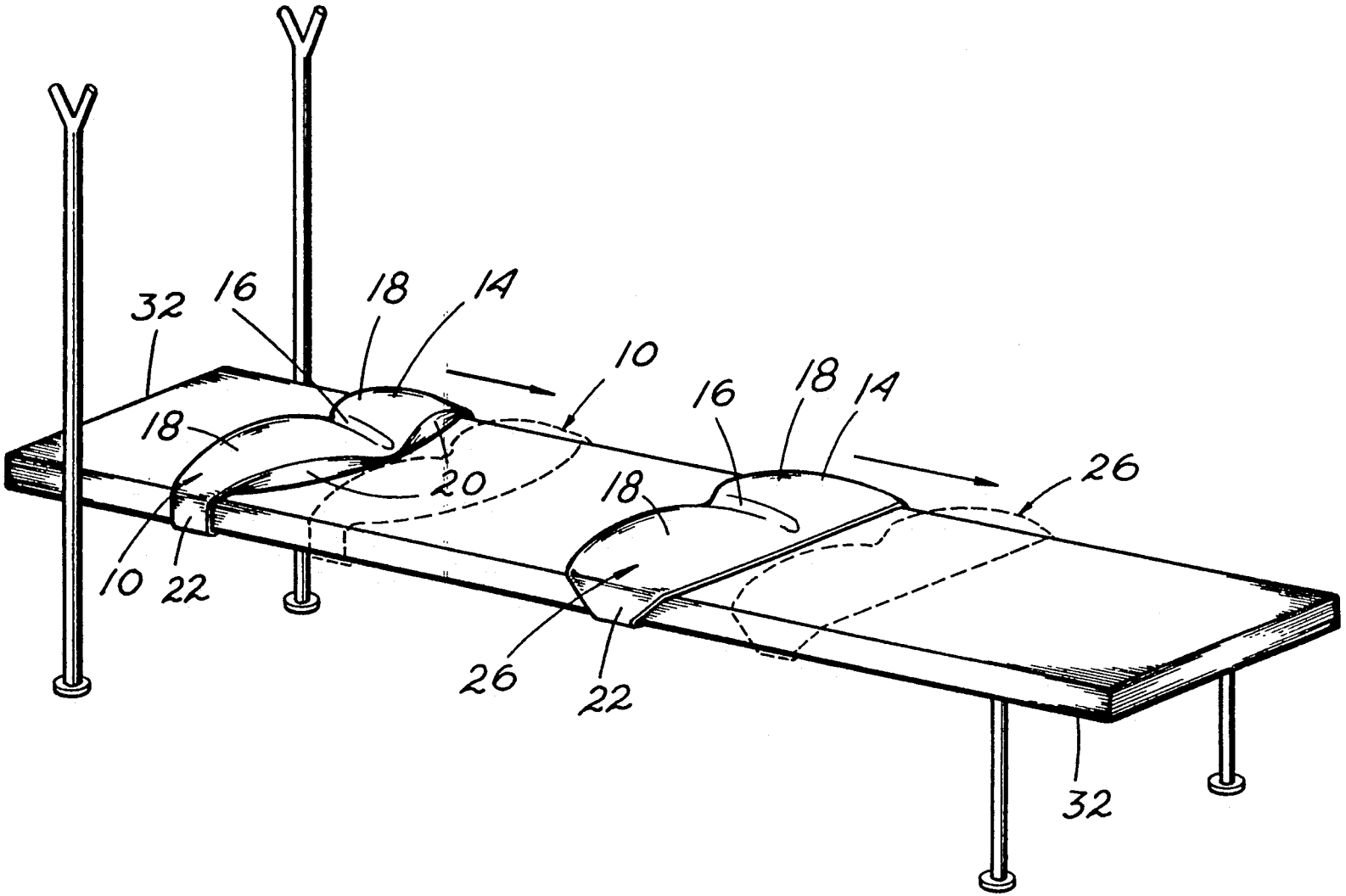
FIG. 8 illustrates both support pads affixed to a weight lifting bench.

In use, both pads 10 and 26 are positioned onto the upper surface of weight bench 32 with top surfaces 14 positioned upward, and straps 22 placed over the sides of bench 32, as shown in FIG. 8. Cervical support pad 10 must be positioned toward the head of bench 32 with shoulder recesses 20 positioned adjacent lumbar support pad 26. Shoulder recesses 20 are particular to the functional use of cervical support pad 10 and are positioned, when in use, adjacent the shoulders of user 34. Experimentation has disclosed that when user 34 lifts weights 40, his or her shoulders tend to rub the straight edges of other neck support pads. To prevent either frictional irritation or discomfort to the shoulders of user 34, cervical support pad 10 has provided shoulder clearance in the form of shoulder recesses 20, formed along the shoulder side edges 15 of both rounded domes 18. Apex 13 of cervical support pad 10 extends downward with spinal recess 16, past the area of neck 36, for the additional support of the upper section of the thoracic vertebrae and upper shoulder area. This provides much more comfortable support than a pad restrained to neck 36 only. To correctly position both pads 10 and 26, user 34 lies supine on the surface of bench 32 and positions cervical support pad 10 under neck 36 and lumbar support pad 26 under lumbar spinal area 38. User 34 then attaches each support pad 10 and 26 by means of hook and loop fasteners 24, or other attachment means.

Figure 9:
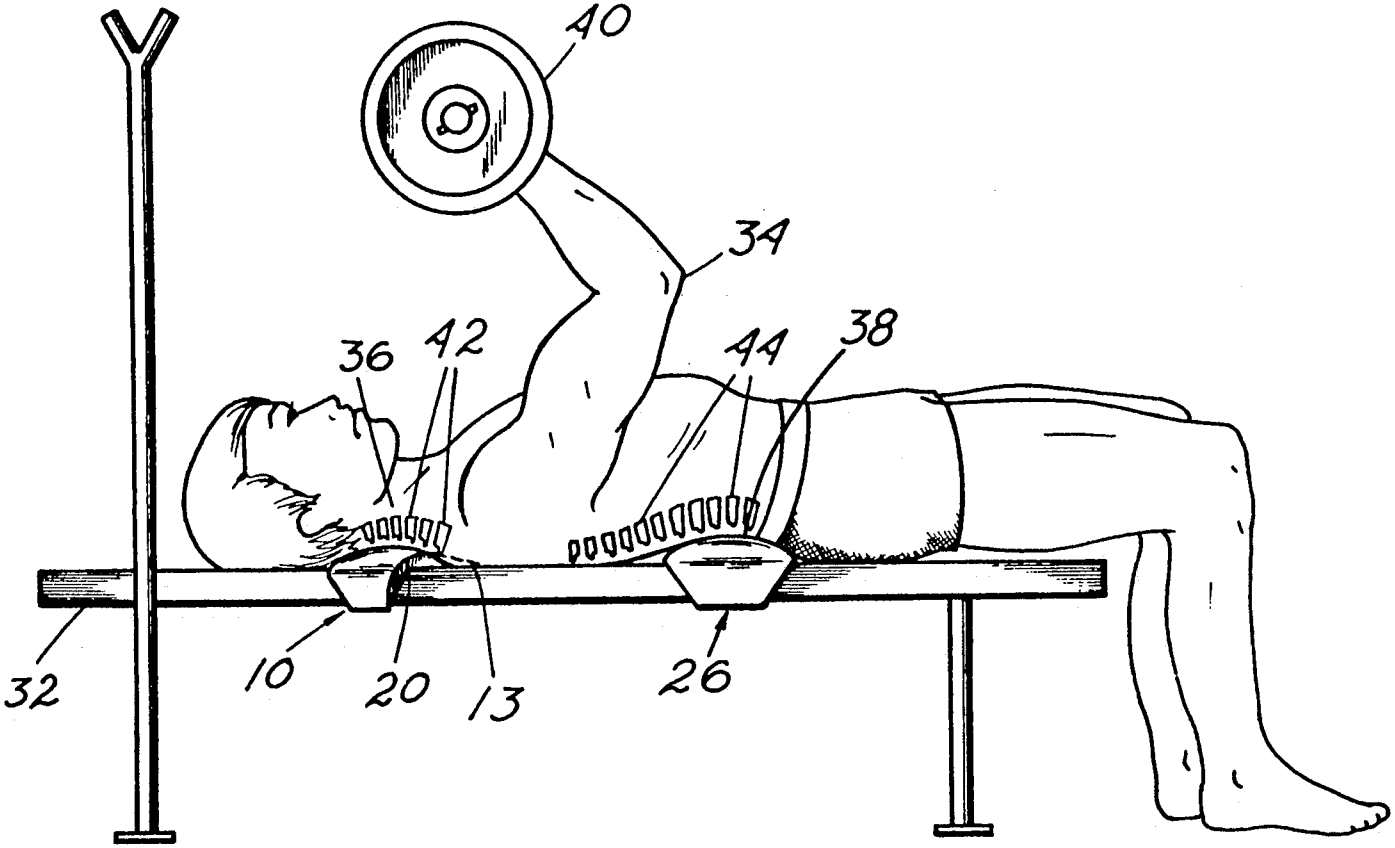
FIG. 9 is an in-use illustration showing the cervical pad positioned under the neck portion of the user supporting the cervical vertebrae, and the lumbar support pad positioned under the lumbar area of the user's back supporting the lumbar vertebrae.
Figure 10:
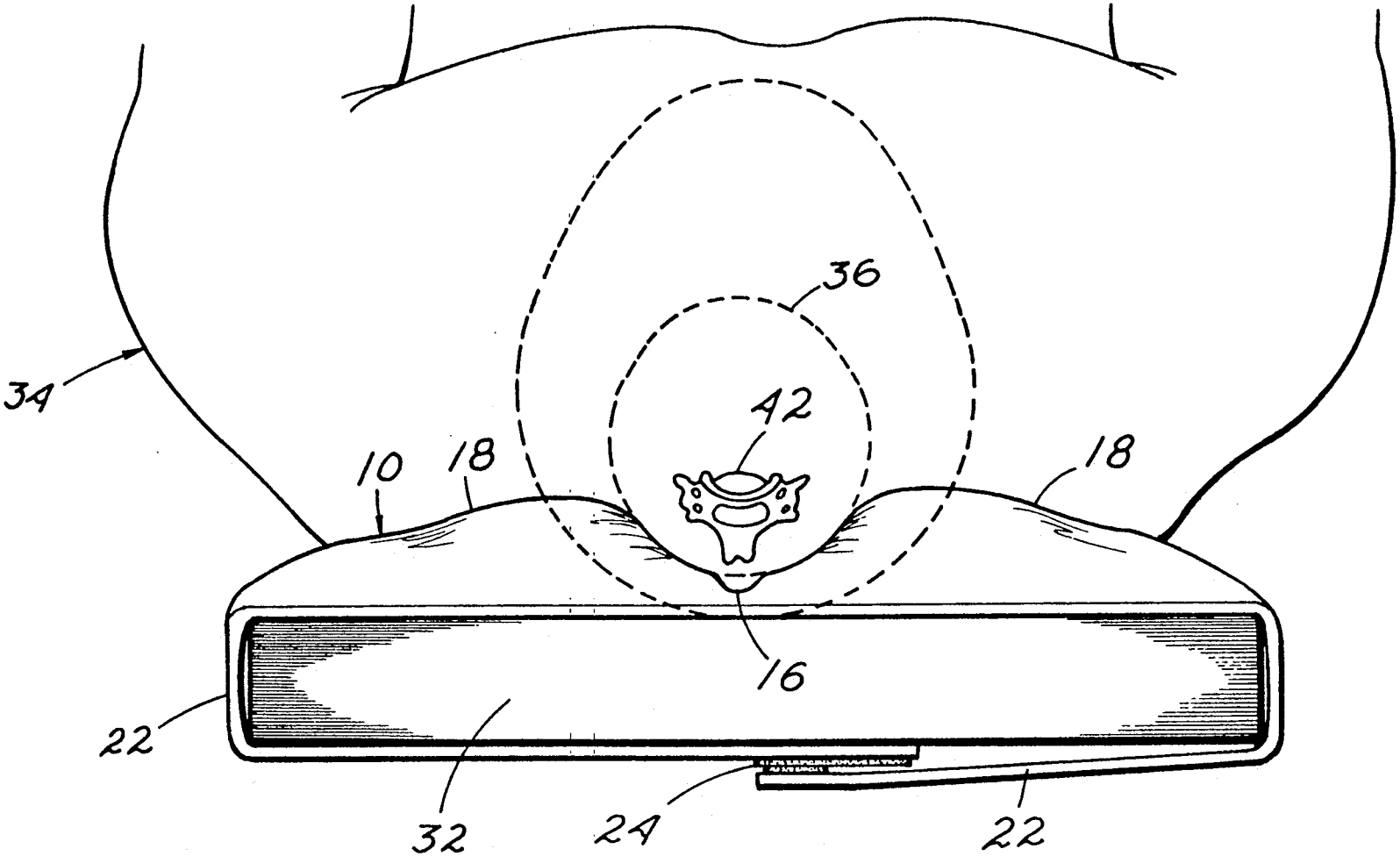
FIG. 10 is an in-use illustration depicting a head end view of the user with the head and neck shown in phantom lines. A cervical vertebra is shown with the spinous processes projecting downward directly over the transverse spinal recess.
Figure 11:
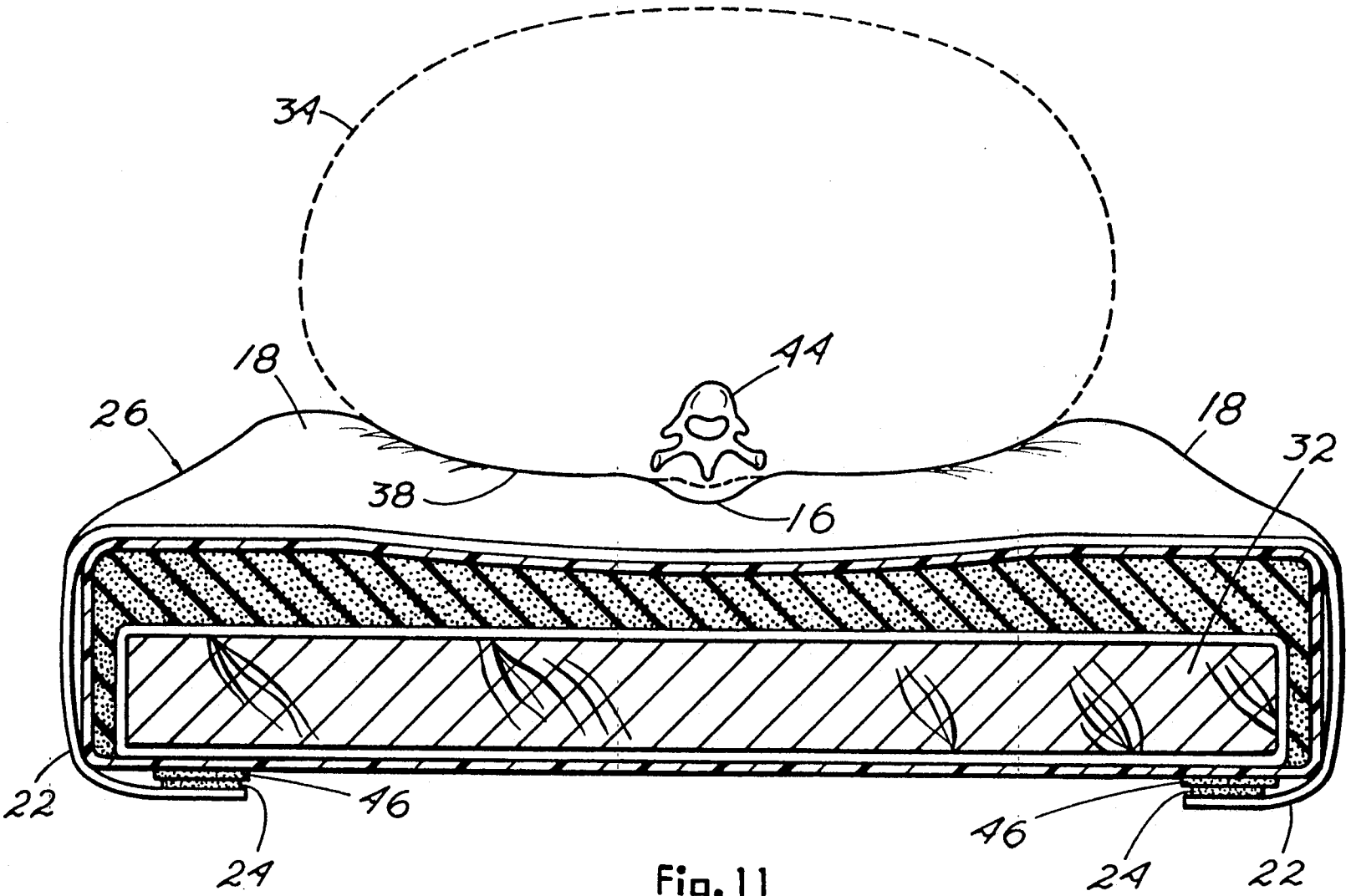
FIG. 11 is an in-use illustration depicting a head end view of the user with the user cross sectioned in the lumbar area, denoted by the dotted outline. The lumbar support pad is shown positioned under the lumbar area of the user with one lumbar vertebra shown received or generally suspended by the spinal recess of the pad. The lumbar pad is illustrated with optional shorter straps, affixed with hook and loop fasteners directly to the lateral edges of a padded weight bench.

When user 34 is in the process of lifting weights 40, as shown in FIG. 9, the normal curvature of cervical vertebrae 42 and lumbar vertebrae 44 may be altered but will still remain within an acceptable curvature range, being maintained by the abutment of the rounded top surface 14 of cervical support pad 10 and lumbar support pad 26 on both sides of the spine. User 34 often tends to twist or displace the torso laterally during certain types of weight lifting which can cause strain on the spinal muscles. The gradual concave surface of spinal recess 16, with the rounded domes 18 forming side embankments, helps to laterally retain the back of user 34, thus maintaining a relatively stable position during weight lifting. The central, lower most depression of spinal recess 16, that which is positioned adjacent the spine in use, also serves to prevent lateral displacement of cervical vertebrae 42 and lumbar vertebrae 44 by forming a protective groove to help maintain or relieve pressure on the spine. Cervical vertebrae 42, shown from a top view in FIG. 10, can be protected from excess compression within spinal recess 16 when the back of user 34 is pressed into pad 10. FIG. 11 illustrates lumbar support pad 26 in use, viewed from the top or head end of user 34, with lumbar spinal area 38 sectioned, represented by dotted outline, to show the placement of lumbar vertebra 44 in relation to spinal recess 16. In this view, padded bench 32 is depicted in cross-section. Straps 22 of lumbar support pad 26 are illustrated in this view being shorter and affixed with hook and loop fasteners 24 directly to the bottom edges of bench 32 to elongated hook and loop strips 46. Elongated hook and loop strips 46 are affixed to the bottom lengthwise edges of bench 32. Although not shown, elongated hook and loop strips 46 can also be affixed to the side edges of bench 32.

Although illustrated as attachable to weight bench 32, both support pads 10 and 26 can be attached to a vertical support structure such as a chair or medical examination table. This versatility is provided through positional adjustment of the wraparound attachment belting.

Even though this invention has been described in detail, it is considered obvious that those skilled in the art could conceivably modify my invention and obtain similar results, therefore, I reserve the right to modify the invention in any manner consistent with the intended scope of the appended claims and modifications made by others which fall within the claim scope, I will consider as my invention.

What is claimed is:

1. In combination, a weight lifter's bench suitable for a human to lay on in a supine position to lift weights, said bench having a first and a second spinal column support pad positioned on an upper surface of said bench, each said support pad being releasably and justably affixed stationary by strapping means to said bench:

each said support pad having a bottom surface placed against said upper surface of said bench, each said support pad having a top surface oppositely disposed from said bottom surface, each said sport pad further having two ends oppositely disposed from one another, each end placed adjacent a side edge of the bench, each said support pad further having two narrow edges oppositely disposed from one another extending between said two ends of said support pad;

each said support pad having a generally centered elongated narrow groove in said top surface extending lengthwise generally from one said side edge of said support pad to said oppositely disposed side edge of said support pad, said narrow groove dividing said top surface of said support pad into two generally rounded domes, said rounded domes sized and placed to support a human on either side of the spinal column thereby stabilizing and maintaining a generally normal spinal column curvature, said narrow groove sized and placed to provide open space for receiving and generally relieving pressure on an area of the spinal column during support on either side thereof by said rounded domes, said first support pad positioned on said bench toward a head end of said bench to support a human's curvical spinal curvature, said second support pad positioned on said bench to support the human's generally normal lumbar spinal curvature simultaneous with said first support pad supporting the human's cervical spinal curvature.

2. In combination, a weight lifter's bench suitable for a human to lay on in a supine position to lift weights, said bench having at least one spinal column support pad positioned on an upper surface of said bench, said support pad being releasably and adjustably affixed stationary by strapping means to said bench;

said support pad having a bottom surface placed against said upper surface of said bench, said support pad having a top surface oppositely disposed from said bottom surface, said support pad further having two ends oppositely disposed from one another, each end placed adjacent a side edge of the bench, said support pad further having two narrow side edges oppositely disposed from one another extending between said two ends of said support pad;

said support pad having a generally centered elongated narrow groove in said top surface extending lengthwise generally from one said side edge of said support pad to said oppositely disposed side edge of said support pad, said narrow groove dividing said top surface of said support pad into two generally rounded domes, said rounded domes sized and placed to support a human on either side of the spinal column thereby stabilizing and maintaining a generally normal spinal column curvature, said narrow groove sized and placed to provide open space for receiving and generally relieving pressure on an area of the spinal column during support on either side thereof by said rounded domes.

* * * * *